US009344792B2

(12) United States Patent
Rundle

(10) Patent No.: US 9,344,792 B2
(45) Date of Patent: May 17, 2016

(54) EAR PRESENCE DETECTION IN NOISE CANCELLING EARPHONES

(71) Applicant: Apple Inc., Cupertino, CA (US)

(72) Inventor: Nicholas A. Rundle, San Jose, CA (US)

(73) Assignee: Apple Inc., Cupertino, CA (US)

( * ) Notice: Subject to any disclaimer, the term of this patent is extended or adjusted under 35 U.S.C. 154(b) by 306 days.

(21) Appl. No.: 13/689,567

(22) Filed: Nov. 29, 2012

(65) Prior Publication Data

US 2014/0146976 A1 May 29, 2014

(51) Int. Cl.
*G10K 11/16* (2006.01)
*H04R 1/10* (2006.01)

(52) U.S. Cl.
CPC ..... *H04R 1/1083* (2013.01); *H04R 2460/01* (2013.01)

(58) Field of Classification Search
None
See application file for complete search history.

(56) References Cited

U.S. PATENT DOCUMENTS

| | | | | |
|---|---|---|---|---|
| 3,794,779 | A | 2/1974 | Greuzerd et al. | |
| 3,796,840 | A | 3/1974 | Ohta | |
| 5,144,678 | A | 9/1992 | Lenz | |
| 5,337,353 | A | 8/1994 | Boie et al. | |
| 5,729,604 | A * | 3/1998 | Van Schyndel | 379/388.01 |
| 5,937,070 | A | 8/1999 | Todter et al. | |
| 6,118,878 | A | 9/2000 | Jones | |
| 6,614,912 | B1 | 9/2003 | Yamada et al. | |
| 6,817,440 | B1 | 11/2004 | Kim | |
| 7,069,018 | B1 | 6/2006 | Granstam et al. | |
| 7,925,029 | B2 | 4/2011 | Hollemans et al. | |
| 8,019,096 | B2 | 9/2011 | Sander et al. | |
| 8,199,956 | B2 | 6/2012 | Haartsen et al. | |
| 8,238,590 | B2 | 8/2012 | Burge | |
| 8,428,053 | B2 | 4/2013 | Kannappan | |
| 8,521,239 | B2 * | 8/2013 | Hosoi et al. | 455/575.1 |

(Continued)

FOREIGN PATENT DOCUMENTS

| | | | |
|---|---|---|---|
| JP | 10028169 A | * | 1/1998 |
| WO | 2011146659 | | 11/2011 |

OTHER PUBLICATIONS

"Method and System is Disclosed for Modifying Audio Channel Routing Based on Operational Condition Associated with One or More Audio Devices." Jul. 16. 2010 (3 pages).

(Continued)

*Primary Examiner* — Thang Tran
(74) *Attorney, Agent, or Firm* — Treyz Law Group, P.C.; Kendall P. Woodruff; Zachary D. Hadd

(57) ABSTRACT

An electronic device may be coupled to an accessory such as a pair of earphones. The earphones may have noise cancellation features that may be implemented using noise cancellation circuitry in the earphones or in the electronic device. The earphones may have ear presence sensor structures that determine whether speakers in the earphones are present at the ears of a user. In one suitable embodiment, control circuitry in the earphones may be used to adjust noise cancellation circuitry in the earphones based on information from the ear presence sensor structures. For example, the control circuitry may deactivate noise cancellation circuitry in response to receiving information from the ear presence sensor structures indicating that the earphones have been removed from a user's ears. In another suitable embodiment, control circuitry in the electronic device may adjust noise cancellation circuitry in the electronic device based on information from the ear presence sensor structures.

17 Claims, 7 Drawing Sheets

(56) References Cited

U.S. PATENT DOCUMENTS

| | | | | |
|---|---|---|---|---|
| 8,954,177 | B2 | 2/2015 | Sanders | |
| 2004/0138723 | A1 | 7/2004 | Malick et al. | |
| 2005/0170859 | A1 | 8/2005 | Koike et al. | |
| 2005/0250553 | A1 | 11/2005 | Lim | |
| 2006/0013079 | A1 | 1/2006 | Rekimoto | |
| 2006/0233413 | A1 | 10/2006 | Nam | |
| 2006/0256133 | A1 | 11/2006 | Rosenberg | |
| 2007/0076897 | A1* | 4/2007 | Philipp | 381/74 |
| 2007/0121959 | A1 | 5/2007 | Philipp | |
| 2007/0169615 | A1 | 7/2007 | Chidlaw et al. | |
| 2008/0157991 | A1 | 7/2008 | Raghunath et al. | |
| 2008/0158000 | A1* | 7/2008 | Mattrazzo | 340/825.25 |
| 2008/0220831 | A1 | 9/2008 | Alameh et al. | |
| 2008/0303947 | A1 | 12/2008 | Ohnishi et al. | |
| 2009/0112696 | A1 | 4/2009 | Jung et al. | |
| 2009/0131124 | A1 | 5/2009 | Bibaud et al. | |
| 2009/0154720 | A1* | 6/2009 | Oki | 381/74 |
| 2009/0285408 | A1* | 11/2009 | Kimura | 381/71.6 |
| 2010/0020998 | A1 | 1/2010 | Brown et al. | |
| 2010/0022283 | A1* | 1/2010 | Terlizzi | H04M 1/05 455/570 |
| 2010/0128887 | A1 | 5/2010 | Lee et al. | |
| 2010/0183175 | A1* | 7/2010 | Chen et al. | 381/309 |
| 2010/0197360 | A1 | 8/2010 | Namgoong et al. | |
| 2010/0310087 | A1 | 12/2010 | Ishida | |
| 2010/0310097 | A1 | 12/2010 | Chang | |
| 2011/0021182 | A1 | 1/2011 | Huan | |
| 2011/0116643 | A1 | 5/2011 | Tiscareno et al. | |
| 2011/0144779 | A1* | 6/2011 | Janse et al. | H04R 1/1041 700/94 |
| 2011/0187868 | A1 | 8/2011 | Chang et al. | |
| 2011/0196519 | A1 | 8/2011 | Khoury et al. | |
| 2011/0286615 | A1 | 11/2011 | Olodort et al. | |
| 2012/0086551 | A1 | 4/2012 | Lowe et al. | |
| 2012/0114154 | A1* | 5/2012 | Abrahamsson | H04R 5/033 381/309 |
| 2012/0207317 | A1 | 8/2012 | Abdollahzadeh Milani et al. | |
| 2012/0230699 | A1* | 9/2012 | Burnett | 398/133 |
| 2012/0244917 | A1* | 9/2012 | Hosoi | H04R 1/028 455/575.1 |
| 2013/0038458 | A1* | 2/2013 | Toivola et al. | 340/665 |
| 2013/0075595 | A1 | 3/2013 | Ruh | |
| 2013/0083933 | A1 | 4/2013 | Aase | |
| 2013/0094659 | A1 | 4/2013 | Liu | |
| 2013/0121494 | A1* | 5/2013 | Johnston | H04R 1/1041 381/56 |
| 2013/0163783 | A1 | 6/2013 | Burlingame | |
| 2013/0236027 | A1* | 9/2013 | Tao | H04R 3/00 381/74 |
| 2014/0016803 | A1 | 1/2014 | Puskarich | |
| 2014/0146979 | A1 | 5/2014 | Puskarich | |
| 2014/0146982 | A1 | 5/2014 | Pelosi | |

OTHER PUBLICATIONS

Acker at al., Smart Audio Output With Presence Sensors: Enabling Mode Switching Using Head Sets or Ear Buds Synaptics Incorporated, San Jose, California, Nov. 2, 2005(10 pages).

"Automated Play/Pause of Music Based on Aggregated Sensor Data," Feb. 2, 2012 (3 pages).

Free on iPhone: Free Apps, Review for iPhone, "iPhone Proximity Sensor", posted Jan. 2, 2009, retrieved Sep. 1, 2011.

Hisahiro Moriuchi "Universal Earphones: Earphones with Automatic Side and Shared Use Detection", 2012, 1 page.

* cited by examiner

EAR PRESENCE DETECTION IN NOISE CANCELLING EARPHONES

BACKGROUND

This relates to electronic devices and, more particularly, to electronic devices with accessories such as earphones.

Accessories such as earphones are often used with media players, cellular telephones, and other electronic devices. Some accessories have microphones that are used to form part of a noise cancellation circuit. When noise cancellation functions are active, the impact of ambient noise on audio playback can be reduced. Microphones can also be used to implement voice microphone noise cancellation.

There can be difficulties associated with noise cancelling earphones. For example, a user who is using earphones to listen to audio while noise cancellation circuitry in the earphones is active may occasionally need to remove the earphones. When doing so, the user may not be able to manually turn off noise cancellation features. Actively running noise cancellation operations in an accessory when a user is not using the accessory increases power consumption and decreases the battery life of the accessory.

It would therefore be desirable to be able to provide improved ways in which to control operation of an electronic device coupled to an accessory such as noise cancelling earphones.

SUMMARY

An electronic device may be coupled to an accessory such as a pair of earphones having noise cancellation features. The noise cancellation features may be used to reduce the impact of ambient noise on the audio content that is played through the earphones.

The earphones may have ear presence sensor structures that determine whether or not speakers in the earphones are present at the ears of the user. Information from the ear presence sensor structures may be used to control the operation of the noise cancellation features. In one suitable embodiment, noise cancellation features may be implemented using noise cancellation circuitry in the earphones. With this type of configuration, control circuitry in the earphones may adjust the noise cancellation circuitry in response to information from the ear presence sensor structures. For example, control circuitry in the earphones may automatically deactivate noise cancellation circuitry when information from the ear presence sensor structures indicates that the earphones have been removed from a user's ears. When information from the ear presence sensor structures indicates that the earphones have been placed in or on the user's ears, the control circuitry in the earphones may, if desired, automatically activate the noise cancellation circuitry.

In another suitable embodiment, noise cancellation features may be implemented using noise cancellation circuitry in the electronic device. With this type of configuration, information from ear presence sensor structures may be conveyed to control circuitry in the electronic device. The control circuitry may adjust the noise cancellation circuitry in response to information received from the ear presence sensor structures. For example, control circuitry in the electronic device may automatically deactivate noise cancellation circuitry when information from the ear presence sensor structures indicates that the earphones have been removed from a user's ears. When information from the ear presence sensor structures indicates that the earphones have been placed in or on the user's ears, the control circuitry in the earphones may, if desired, automatically activate the noise cancellation circuitry.

Controlling the operation of noise cancellation circuitry based on whether or not the earphones are present at the user's ears may reduce the power consumption of a battery in the earphones or in the electronic device.

The ear presence sensor structures may include switch-based sensors, accelerometer-based sensors, light-based sensors, or other suitable types of sensors.

Further features of the invention, its nature and various advantages will be more apparent from the accompanying drawings and the following detailed description of the preferred embodiments.

DETAILED DESCRIPTION

Electronic device accessories such as earphones may be provided with noise cancellation features. When noise cancellation features are activated, the impact of ambient noise on audio content that is played through the earphones can be reduced. Noise cancellation features may also be used to perform voice microphone noise cancellation.

Noise cancellation features may be implemented using one or more noise cancellation microphones. For example, a voice microphone in the accessory may have an associated noise cancellation microphone that picks up ambient noise in the vicinity of the voice microphone.

Earphone speaker housings in an accessory may also have noise cancellation microphones. For example, each earphone speaker housing in a headset may have an external noise cancellation microphone on an outer surface of the earphone speaker housing. In addition to the external noise cancellation microphone or instead of the external noise cancellation microphone, each earphone speaker housing may have an internal noise cancellation microphone on an interior surface of the earphone speaker housing (e.g., adjacent to the ear).

In accessories with more speakers, more noise cancellation microphones may be used. For example, additional noise cancellation microphones can be provided in earbuds that contain multiple drivers or in surround sound accessories. A surround sound accessory might, for example, have five or six speakers (or more) and might have a noise cancellation microphone that is adjacent to each respective speaker.

Accessories such as earphones having noise cancellation features may be provided with the ability to sense the presence of external objects. For example, an earphone accessory may be provided with sensor structures such as ear presence sensor structures that can determine whether or not the earphones (i.e., the earphone speakers) are located in or on the ears of a user.

Information gathered by the sensor structures may be used to control the operation of noise cancellation features in the earphones. For example, control circuitry in the accessory or in the electronic device may automatically activate or deactivate noise cancellation features based on whether or not the earphones are located in or on the ears of a user. Controlling noise cancellation features in a pair of earphones coupled to an electronic device based on whether or not the user is wearing the earphones may reduce power consumption and extend the battery life of the earphones and/or of the electronic device.

Figure 1:
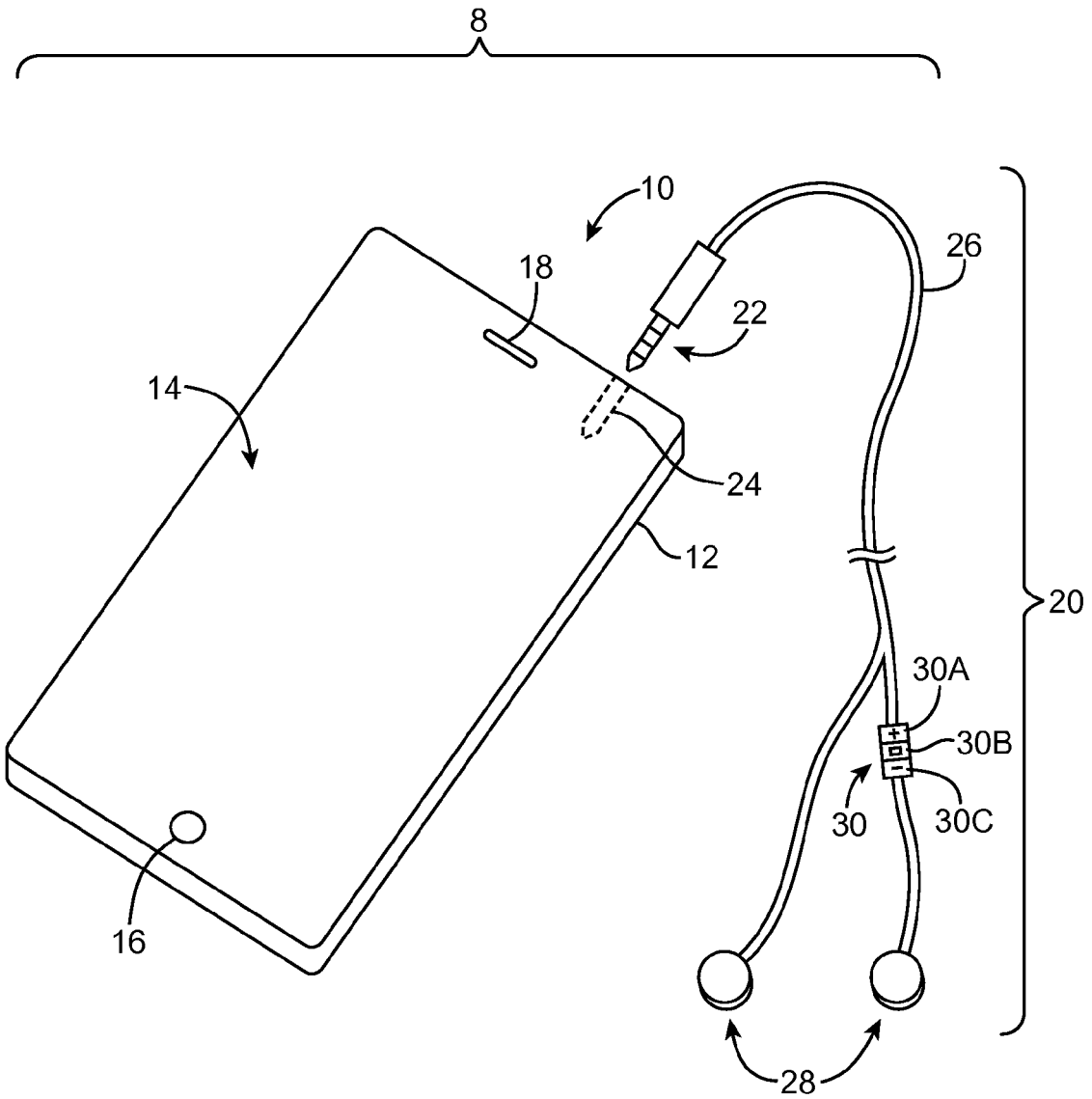
FIG. 1 is a front perspective view of an illustrative electronic device and associated accessory in accordance with an embodiment of the present invention.

FIG. 1 is a diagram of a system of the type that may be provided with an accessory having noise cancellation features for reducing the impact of ambient noise and sensing structures for detecting the presence of external objects such as the ears of a user. As shown in FIG. 1, system 8 may include electronic device 10 and accessory 20.

Electronic device 10 may include a display such as display 14. Display 14 may be a touch screen that incorporates a layer of conductive capacitive touch sensor electrodes or other touch sensor components or may be a display that is not touch-sensitive. Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies. Configurations in which display 14 includes display layers that form liquid crystal display (LCD) pixels may sometimes be described herein as an example. This is, however, merely illustrative. Display 14 may include display pixels formed using any suitable type of display technology.

Display 14 may be protected using a display cover layer such as a layer of transparent glass or clear plastic. Openings may be formed in the display cover layer. For example, an opening may be formed in the display cover layer to accommodate a button such as button 16 and an opening such as opening 18 may be used to form a speaker port.

Device 10 may have a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials.

Housing 12 may be formed using a unibody configuration in which some or all of housing 12 is machined or molded as a single structure or may be formed using multiple structures (e.g., an internal frame structure, one or more structures that form exterior housing surfaces, etc.). The periphery of housing 12 may, if desired, include walls. One or more openings may be formed in housing 12 to accommodate connector ports, buttons, and other components. For example, an opening may be formed in the wall of housing 12 to accommodate audio connector 24 and other connectors (e.g., digital data port connectors, etc.). Audio connector 24 may be a female audio connector (sometimes referred to as an audio jack) that has two pins (contacts), three pins, four pins, or more than four pins (as examples). Audio connector 24 may mate with male audio connector 22 (sometimes referred to as an audio plug) in accessory 20.

Accessory 20 may be a pair of earphones (e.g., earbuds or earphones with other types of speakers), other audio equipment (e.g., an audio device with a single earbud unit), or other electronic equipment that communicates with electronic device 10. The use of a pair of earphones in system 8 is sometimes described herein as an example. This is, however, merely illustrative. Accessory 10 may be implemented using any suitable electronic equipment.

It should be understood that the term "earphones" may refer to any suitable type of audio headset (e.g., headphones, over-the-ear headphones, earbuds, earbud-type headphones with ear hooks, in-ear headphones that extend partially into the ear canal, etc.).

As shown in FIG. 1, accessory 20 may include a communications path such as cable 26 that is coupled to audio plug 22. Cable 26 may contain conductive lines (e.g., wires) that are coupled to respective contacts (pins) in audio connector 22. The conductive lines of cable 26 may be used to route audio signals from device 10 to speakers in earphone units 28. Earphone units 28 (which may sometimes be referred to as speakers or earphone housings) may include sensor structures for determining when earphone units 28 have been placed within the ears of a user. Microphone signals may be gathered using a microphone mounted in controller unit 30. Controller unit 30 may also have buttons that receive user input from a user of system 8. A user may, for example, manually control the playback of media by pressing button 30A to play media or increase audio volume, by pressing button 30B to pause or stop media playback, and by pressing button 30C to reverse media playback or decrease audio volume (as examples).

The circuitry of controller 30 may communicate with the circuitry of device 10 using the wires or other conductive paths in cable 26 (e.g., using digital and/or analog communications signals). The paths in cable 26 may also be coupled to speaker drivers in earphones 28, so that audio signals from device 10 may be played through the speakers in earbuds 28. Electronic device 10 may regulate the volume of sound produced by earbuds 28 by controlling the audio signal strength used in driving the speakers in earbuds 28.

In one suitable embodiment, sensor signals from sensor structures in earbuds 28 may be conveyed to device 10 using the conductive paths of cable 26. With this type of configuration, electronic device 10 may process the sensor signals and take suitable action based on a determination of whether or not earphones 20 are located in or on a user's ears.

Figure 2:
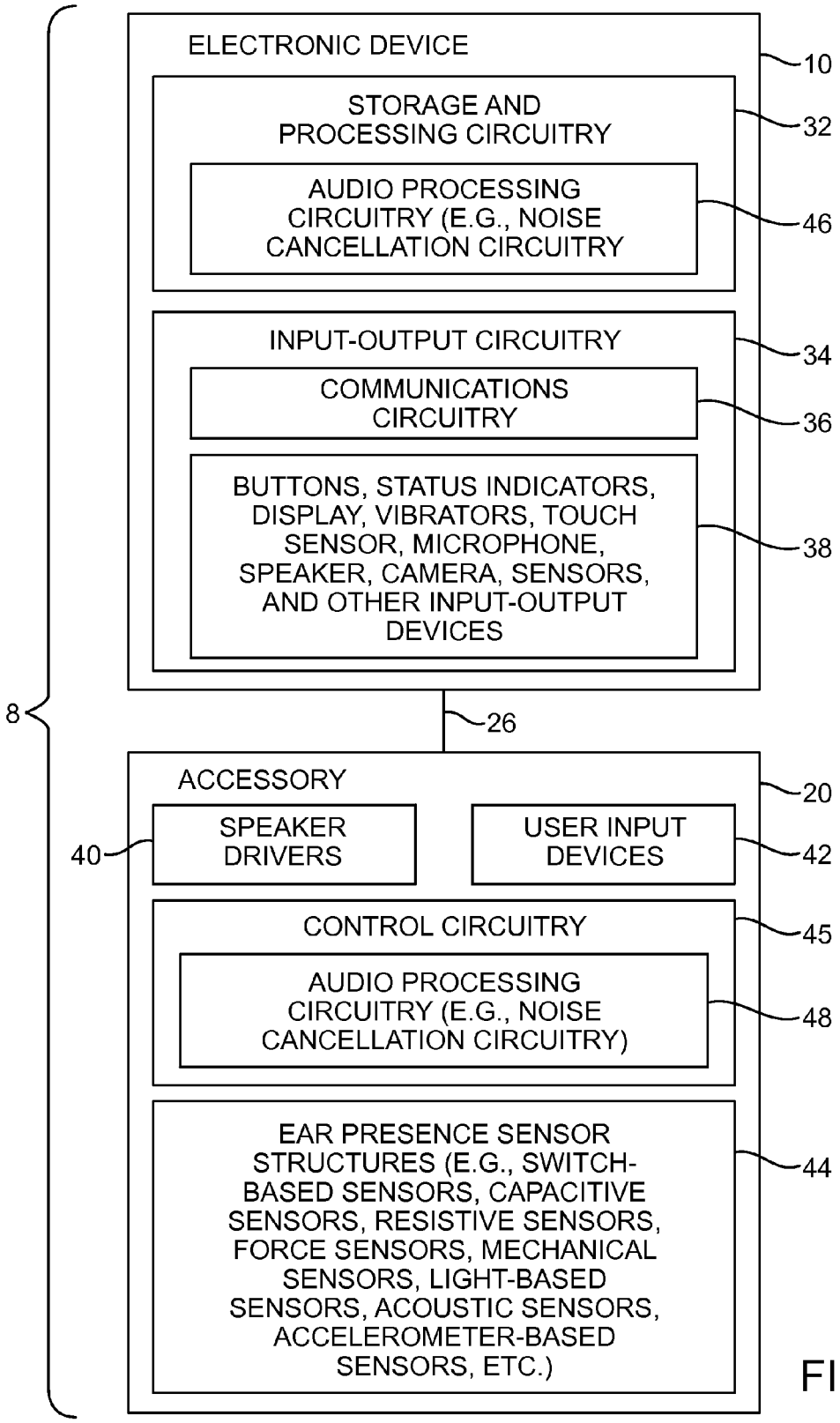
FIG. 2 is a schematic diagram of an illustrative electronic device and associated accessory in accordance with an embodiment of the present invention.

A schematic diagram showing illustrative components that may be used in device 10 and accessory 20 of system 8 is shown in FIG. 2. As shown in FIG. 2, electronic device 10 may include control circuitry 32 and input-output circuitry 34. Control circuitry 32 may include storage and processing circuitry that is configured to execute software that controls the operation of device 10. Control circuitry 32 may be implemented using one or more integrated circuits such as microprocessors, application specific integrated circuits, memory, and other storage and processing circuitry. Control circuitry 32 may, if desired, include noise cancellation circuitry and other audio processing circuitry 46.

Input-output circuitry 34 may include components for receiving input from external equipment and for supplying output. For example, input-output circuitry 34 may include user interface components for providing a user of device 10 with output and for gathering input from a user. As shown in FIG. 2, input-output circuitry 34 may include communications circuitry 36. Communications circuitry 36 may include wireless circuitry such as radio-frequency transceiver circuitry with a radio-frequency receiver and/or a radio-frequency transmitter. Radio-frequency transceiver circuitry in the wireless circuitry may be used to handle wireless signals in communications bands such as the 2.4 GHz and 5 GHz WiFi® bands, cellular telephone bands, and other wireless communications frequencies of interest. Communications circuitry 36 may also include wired communications circuitry such as circuitry for communicating with external equipment over serial and/or parallel digital data paths.

Input-output devices 38 may include buttons such as sliding switches, push buttons, menu buttons, buttons based on dome switches, keys on a keypad or keyboard, or other switch-based structures. Input-output devices 38 may also include status indicator lights, vibrators, display touch sensors, speakers, microphones, camera sensors, ambient light sensors, proximity sensors, and other input-output structures.

Electronic device 10 may be coupled to components in accessory 20 using cables such as cable 26 of accessory 20. Accessory 20 may include speakers such as a pair of speaker drivers 40 (e.g., a left speaker and a right speaker). If desired, accessory 20 may include more than one driver per earbud. For example, each earbud in accessory 20 may have a tweeter, a midrange driver, and a bass driver (as an example). Speaker drivers 40 may be mounted in earbuds or other earphone housings. The use of left and right earbuds to house respective left and right speaker drivers 40 is sometimes described herein as an example.

Accessory 20 may include control circuitry such as control circuitry 45. Control circuitry 45 may, for example, include storage and processing circuits formed from one or more integrated circuits or other circuitry. Circuitry 45 in accessory 20 may include noise cancellation circuitry and other audio processing circuitry 48, if desired.

Cables such as cable 26 may form a communications path that can be used in conveying signals between device 10 and accessory 20. The communications path may be used to transmit audio from circuitry 32 to speaker drivers 40 during playback operations.

The communications path may also be used to convey noise signals. Noise cancellation may, for example, be performed using the processing circuitry of device 10 (e.g., using noise cancellation circuitry 46). In this type of arrangement, noise signals gathered by one or more microphones in earphones 20 may be routed to circuitry 46. Circuitry 46 may then route audio signals from which noise has been cancelled to headset 20. If desired, noise cancellation operations may be performed locally in headset 20. With this type of arrangement, noise cancellation circuitry 48 in headset 20 can receive audio playback signals from device 10 and can receive noise signals from noise cancellation microphones in earphones 20. Circuitry 48 can then cancel noise from the played back audio.

If desired, accessory 20 may include user input devices 42 such as buttons (see, e.g., the buttons associated with button controller 30 of FIG. 1), touch-based input devices (e.g., touch screens, touch pads, touch buttons), a microphone to gather voice input, other microphones such as noise cancellation microphones, and other user input devices.

To determine whether or not the earbuds in which speaker drivers 40 are located in or on the ears of a user, accessory 20 may be provided with ear presence sensor structures 44. Ear presence sensor structures 44 may be configured to detect whether or not the speakers of earphones 20 are present at the ears of a user. Ear presence sensors may be formed from force sensors, from switches or other mechanical sensors, from capacitive sensors, from resistance-based sensors, from light-based sensors, from accelerometer-based sensors, and from acoustic-based sensors such as ultrasonic acoustic-based sensors (as examples). Control circuitry 45 in accessory 20 and/or control circuitry 32 of electronic device 10 may use information from ear presence sensor structures 44 in determining which actions should be automatically taken by device 10 and/or by accessory 20.

Figure 3:
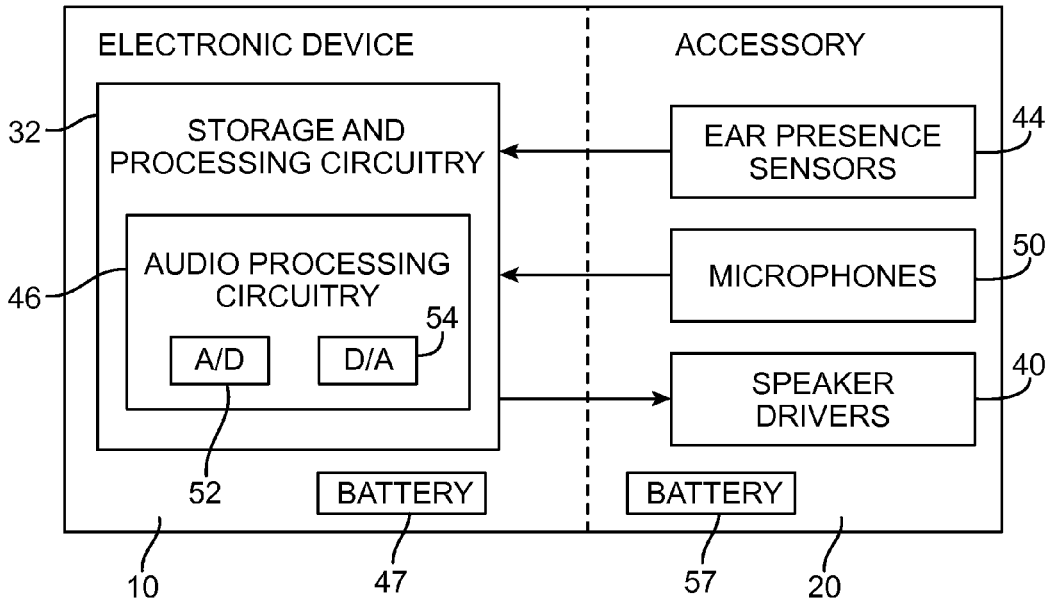
FIG. 3 is a schematic diagram of an illustrative electronic device and associated accessory in which noise cancellation circuitry is located in the electronic device in accordance with an embodiment of the present invention.

A schematic diagram of device 10 and accessory 20 in a configuration in which noise cancellation circuitry is located in device 10 is shown in FIG. 3. As shown in FIG. 3, accessory 20 may include one or more microphones such as microphones 50. Microphones 50 may include noise cancellation microphones that are used to gather ambient noise signals associated with speakers 40. For example, a first microphone 50 may be configured to gather ambient noise signals associated with a left speaker driver 40, while a second microphone 50 may be configured to gather ambient noise signals associated with a right speaker driver 40. Using noise cancellation techniques, the ambient noise signals can be used to reduce noise in the audio being played through speakers 40.

Noise cancellation techniques can also be implemented for microphones. For example, microphones 50 may include a voice microphone and a corresponding noise cancellation microphone. The voice microphone may be used to gather a user's voice signals during telephone calls or to record audio clips, while the corresponding noise cancellation microphone may be used to gather ambient noise signals associated with the voice microphone. Ambient noise signals gathered by the noise cancellation microphone may be used to reduce noise in the voice signals gathered by the voice microphone.

Noise cancellation operations may be performed using analog circuitry or using digital processing techniques. Noise cancellation operations may be performed locally in accessory 20 or may be performed remotely in device 10. In the example of FIG. 3, noise cancellation operations are performed remotely in device 10.

As shown in FIG. 3, device 10 may include audio processing circuitry 46. Audio processing circuitry 46, which is sometimes referred to as a codec or audio codec, may be used to generate audio signals, to receive and process audio signals, and to receive and process sensor signals from sensor structures 44. Circuitry 46 may include analog-to-digital (A/D) converter circuitry 52 and digital-to-analog (D/A) converter circuitry 54. Analog-to-digital converter circuitry 52 in device 10 may be used to digitize analog signals such as analog audio signals. For example, analog-to-digital converter circuitry 52 may be used to digitize one or more analog microphone signals such as analog microphone signals gathered by microphones 50. Digital-to-analog converter circuitry 54 may be used to generate analog output signals. For example, digital-to-analog converter circuitry 54 may receive digital signals corresponding to the audio portion of a media playback event, audio for a telephone call, noise signals, an alert tone or signal (e.g., a beep or ring), or any other digital information. Based on this digital information, digital-to-analog converter circuitry 54 may produce corresponding analog signals (e.g., analog audio).

Audio processing circuitry 46 may be powered by a power source such as battery 47. If desired, accessory 20 may also include a power source such as battery 57. This is, however, merely illustrative. The use of a battery such as battery 57 in accessory 20 is optional and is only shown as an illustrative example.

Audio processing circuitry 46 may include a digital signal processor that may be used to perform digital signal processing on digitized audio signals. For example, if operating accessory 20 in a noise cancellation mode, noise signals from microphones 50, which may reflect the amount of ambient noise in the vicinity of speaker drivers 40 and/or the amount of ambient noise in the vicinity of a voice microphone) may be conveyed to audio processing circuitry 46 in device 10. Using the processing capabilities of an audio digital signal processor in circuitry 46, the noise signals can be digitally removed from digital audio voice signals and from digital speakers signals.

This is, however, merely illustrative. If desired, circuitry 46 may perform noise cancellation operations using analog noise cancellation circuitry. With this type of configuration, noise signals gathered by microphones 50 may be conveyed to circuitry 46 in device 10. Audio processing circuitry 46 may produce an anti-noise signal and may convey the anti-noise signal to speaker drivers 40 along with the audio signal that is to be heard by the user. The anti-noise signal may be identical to the noise signal except that it is shifted by 180 degrees with respect to the noise signal. The anti-noise signal may be superimposed onto the noise signal such that destructive interference occurs and the two signals mutually cancel.

Noise cancellation circuitry of the type shown in FIG. 3 may be controlled manually by the user and/or may be controlled automatically based on sensor signals gathered by ear presence sensor structures 44. For example, audio control circuitry 32 may automatically deactivate noise cancellation functions when information from sensor structures 44 indicates that earphones 20 have been removed from a user's ears and may automatically activate noise cancellation functions when information from sensor structures 44 indicates that earphones 20 have been placed in or on a user's ears. Because power is required to perform active noise cancellation operations, automatically controlling noise cancellation functions based on whether or not earphones 20 are in a user's ears may optimize the battery life of device 10.

Figure 4:
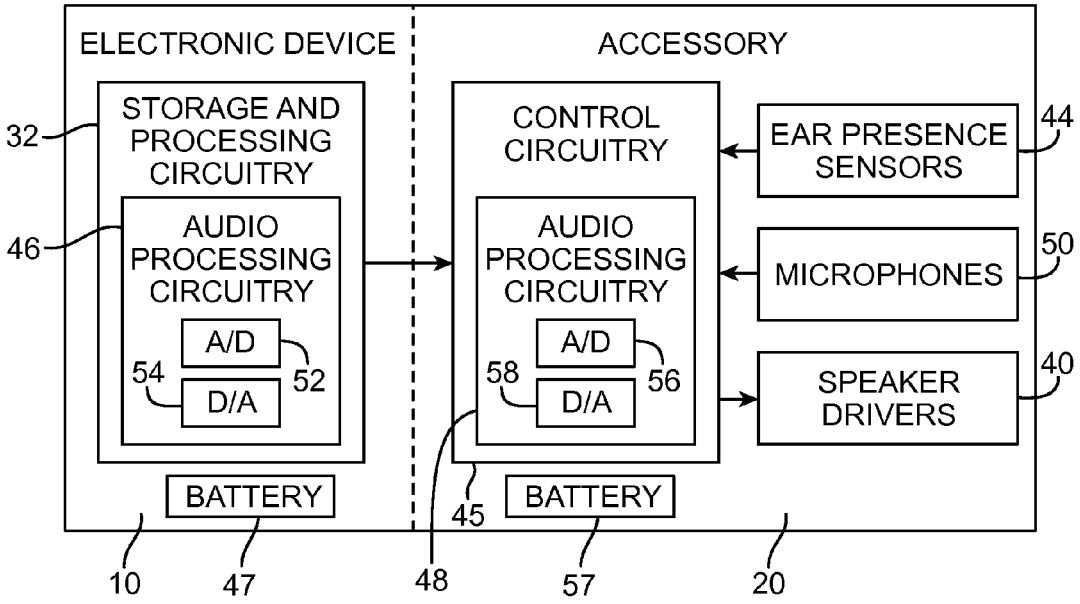
FIG. 4 is a schematic diagram of an illustrative electronic device and associated accessory in which noise cancellation circuitry is located in the accessory in accordance with an embodiment of the present invention.

If desired, audio signal processing operations for implementing noise cancellation functions may be performed locally in accessory 20. As shown in FIG. 4, accessory 20 may include audio signal processing circuitry 48. Circuitry 48 may include analog-to-digital converter circuitry 56 (e.g., for digitizing analog audio signals from a microphone in accessory 20) and digital-to-analog converter circuitry 58 (e.g., to convert digital signals to analog signals that are played back through the speakers of accessory 20). If desired, audio processing circuitry 48 may receive power from a power supply such as battery 57 or may be powered using other methods (e.g., device 10 may provide power to accessory 20 via cable 26 of FIG. 1). The use of a battery such as battery 57 in accessory 20 is merely illustrative.

Circuitry 48 may be used to locally implement noise cancellation functions. In a typical local noise cancellation arrangement using digital processing techniques, analog microphone signals (noise signals) from microphones 50 are digitized using analog-to-digital circuitry 56. Processing circuitry 48 may receive audio signals (e.g., played back music) from device 10 in digital form. Audio processing circuitry 48 may then use digital processing techniques to remove noise from the played back audio. The resulting audio signal may be converted to analog for speakers 40 using digital-to-analog converter circuitry 58.

This is, however, merely illustrative. If desired, circuitry 48 may perform noise cancellation operations using analog noise cancellation circuitry. With this type of configuration, noise signals gathered by microphones 50 may be conveyed to circuitry 48 in accessory 20. Audio processing circuitry 48 may produce an anti-noise signal and may convey the anti-noise signal to speaker drivers 40. The anti-noise signal may be identical to the noise signal except that it is shifted by 180 degrees with respect to the noise signal. The anti-noise signal may be superimposed onto the noise signal such that destructive interference occurs and the two signals mutually cancel.

Noise cancellation circuitry of the type shown in FIG. 4 may be controlled manually by the user and/or may be controlled automatically based on sensor signals gathered by ear presence sensor structures 44. For example, control circuitry 45 may automatically deactivate noise cancellation functions when information from sensor structures 44 indicates that earphones 20 have been removed from a user's ears and may automatically activate noise cancellation functions when information from sensor structures 44 indicates that earphones 20 have been placed in or on a user's ears. Because power is required to perform active noise cancellation operations, automatically controlling noise cancellation functions based on whether or not earphones 20 are in a user's ears may optimize the battery life of earphones 20.

Figure 5:
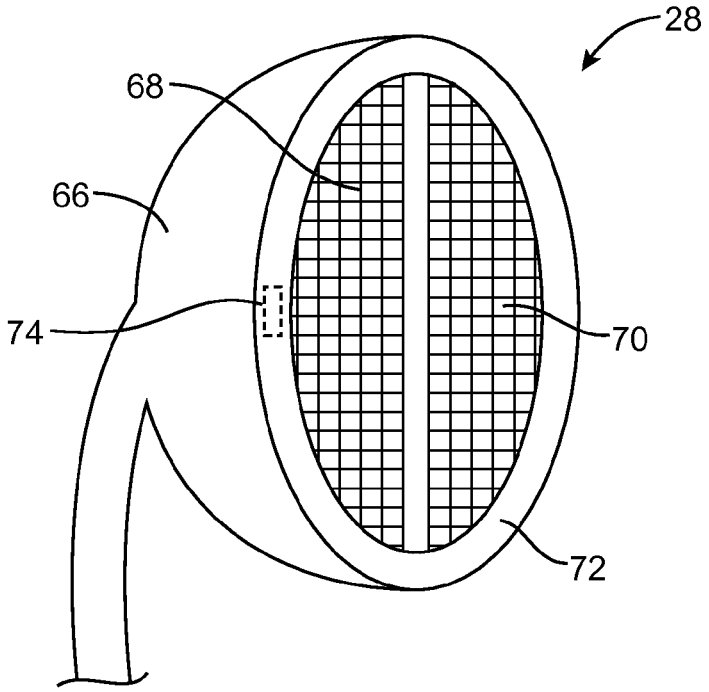
FIG. 5 is a perspective view of an illustrative speaker housing such as an earbud speaker housing that has ear presence sensor structures in accordance with an embodiment of the present invention.

An illustrative earbud speaker housing with an ear presence sensor is shown in FIG. 5. In the example of FIG. 5, earbud 28 has a housing such as housing 66 in which one or more speaker drivers such as speakers 40 of FIG. 2 are mounted.

Conductive structures such as conductive mesh structures 68 and 70 may be mounted in housing 66. As shown in FIG. 5, for example, mesh structures 68 and 70 may be mounted in the front of housing 66 so that sound from the speakers inside earbud housing 66 may pass through the holes of the mesh. If desired, earbud 28 may contain microphone structures (e.g., when implementing noise cancellation features in earbud 28). The use of mesh when forming electrode structures 68 and 70 may allow ambient sound to be picked up by the noise cancellation microphones in housing 66.

Mesh electrodes 68 and 70 (e.g., metal screen structures) or other conductive structures in earbud 28 may be used as first and second terminals in a resistive (resistance-based) sensor. Control circuitry in housing 66 may be used to apply a voltage across the first and second terminals while measuring how much current flows as a result. The control circuitry may use information on the voltage and current signals that are established between electrodes 68 and 70 to determine whether or not earbud 28 has been placed in the ear of a user. In the absence of the user's ear, the resistance between electrodes 68 and 70 will be relatively high. When, however, earbud 28 has been placed into a user's ear, contact between electrodes 68 and 70 and the flesh of the ear will give rise to a lower resistance path between electrodes 68 and 70.

To determine whether or not earbud 28 has been placed within the user's ear, control circuitry 45 of earbud (and/or control circuitry 32 of FIG. 2) may measure the resistance between electrodes 68 and 70 and may compare the measured resistance to a predetermined threshold. When the measured resistance is below the predetermined threshold, circuitry 45 can conclude that earbud 28 has been placed in the ear of the user and may, if desired, automatically activate noise cancellation circuitry. When the measured resistance exceeds the predetermined threshold, circuitry 45 can conclude that earbud 28 is out of the ear and may, if desired, automatically deactivate noise cancellation circuitry.

In configurations where noise cancellation functions are performed remotely in device 10, control circuitry 32 in device 10 may analyze sensor signals from ear presence sensors in earphones 20 and may automatically activate and deactivate noise cancellation circuitry in device 10 based on the sensor signals. Configurations in which noise cancellation is performed and controlled locally in earphones 20 and in which sensor signals from ear presence sensors are analyzed by control circuitry 45 in earphones 20 are sometimes described herein as an example.

In addition to or instead of using mesh 68 and 70 to measure the resistance of the user's ear, mesh electrodes 68 and 70 may be used as capacitive sensor electrodes (e.g., to make mutual capacitance measurements or to make self capacitance measurements). Different capacitance values may be detected in the presence and absence of the user's ear in the vicinity of electrodes 68 and 70. This allows circuitry 45 to use the capacitance measurements to determine whether or not earbud 28 is in, on, or out of the user's ear.

If desired, earbud 28 may include a sealing member such as compressible sealing member 72. Sealing member 72 may be used to form a seal between a user's ear and earbud 28 that helps block ambient noise while also forming an enclosed cavity adjacent to the ear canal. In addition to or instead of using mesh 68 and 70 to detect the presence of a user's ear, an ear presence sensor such as ear presence sensor 74 may be embedded in or formed on sealing member 72.

As an example, ear presence sensor 74 may be a switch-based sensor such as a switch or button that is actuated when a user's ear is present or absent. Switch 74 may be mounted on an exterior surface of earbud housing 66 or may be embedded or formed on sealing member 72. Switch 74 may be configured to move inwards (e.g., towards the interior of housing 66) and to move outwards (e.g., towards the exterior of housing 66). When earbud 28 is inserted into a user's ear, switch 74 may be compressed inward. When earbud 28 is out of the user's ear, switch 74 may move outwards to regain its original uncompressed state. Circuitry 45 may use information from switch structures such as switch structure 74 to determine whether or not earbud 28 has been placed in a user's ear. If desired, a switch-based ear presence sensor of this type may be implemented without requiring electrical power.

As additional examples, sensor structure 74 may be an accelerometer-based sensor, an orientation sensor, or other sensor that may be used in gathering earphone movement information and/or determining the location or orientation of earbud 28. Changes in orientation and/or changes in acceleration may be used to determine whether or not earphones 20 are in or on a user's ears. For example, when movement is detected by sensor 74, circuitry 45 can conclude that earphones 20 are not in the user's ears. When movement is not detected by sensor 74 for a predetermined period of time, circuitry 45 can conclude that earphones 20 are not in the user's ears.

If desired, ear presence sensor 74 may be a pressure or force sensor configured to measure a pressure or force against sealing member 72. In force-based sensor schemes, the resistance of a compressible foam may be measured or a strain gauge output can be monitored. When force is present, circuitry 45 can conclude that earphones 20 have been inserted into or mounted on a user's ears, whereas when force is not present, circuitry 45 can conclude that earphones 20 are not being worn by the user. Force indicative of a user's ear pressing against earphones 20 may also be monitored using piezoelectric force sensors or other force sensors.

These examples are, however, merely illustrative. In general, any suitable type of sensor may be used to detect the presence and/or absence of a user's ear in the vicinity of earbud 28.

Figure 6:
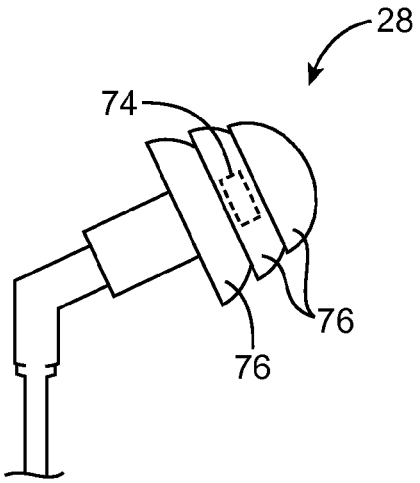
FIG. 6 is a perspective view of an illustrative speaker housing such as an in-ear speaker housing that has ear presence sensor structures in accordance with an embodiment of the present invention.

FIG. 6 is a perspective view of an illustrative in-ear speaker housing with an ear presence sensor. In the example of FIG. 6, in-ear earbud 28 includes sealing members 76 configured to extend partially into the ear canal of a user's ear. Earphones of the type shown in FIG. 6 are sometimes referred to as ear-canal headphones.

As shown in FIG. 6, ear presence sensor 74 may be embedded in or formed on one of sealing members 76. Ear presence sensor 74 may be an accelerometer-based sensor, a pressure or force sensor, a capacitive sensor, a switch-based sensor (e.g., sensor 74 may be a mechanical switch that is actuated when earbud 28 is inserted or removed from a user's ear), or any other suitable type of sensor configured to detect the presence and/or absence of a user's ear in the vicinity of earbud 28.

Figure 7:
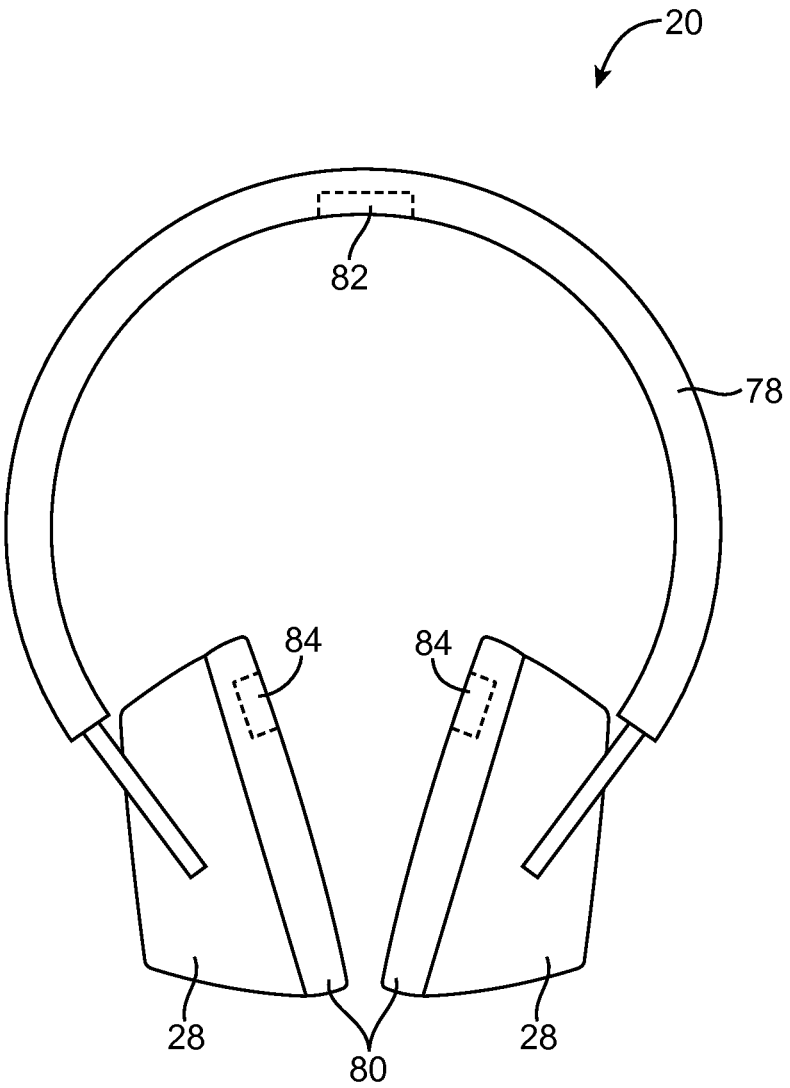
FIG. 7 is a perspective view of illustrative earphones such as over-the-ear headphones that have ear presence sensor structures in accordance with an embodiment of the present invention.

FIG. 7 is a perspective view of illustrative over-the-ear headphones having one or more ear presence sensor structures. In the example of FIG. 7, accessory 20 includes a headband such as headband 78 with left and right over-the-ear speaker housings 28. A sealing member such as sealing member 80 may be a ring or layer of foam or may be any other suitable type of ear pad configured to form a seal around the user's ear to help block out ambient noise.

As shown in FIG. 7, accessory 20 may include one or more user detection sensors such as ear presence sensor structures 82 and 84. Ear presence sensor structures 84 may be embedded in or formed on sealing members 80 and may be configured to detect the presence and absence of a user's ears in the vicinity of speaker housings 28. Ear presence sensor 82 may be embedded in or formed on headband portion 78 and may be configured to detect the presence and absence of a user's head adjacent to headband 78. When information from sensor 82 indicates that a user's head is not present, device 10 can conclude that the user is not wearing headphones 20. When information from sensor 82 indicates that a user's head is present, device 10 can conclude that the user is wearing headphones 20.

Ear presence sensor structures 82 and 84 may be accelerometer-based sensors, pressure or force sensors, capacitive sensors, acoustic-based sensors, switch-based sensors (e.g., sensors formed form mechanical switches that are actuated when a user's ear or head is present or absent), or any other suitable type of sensor configured to detect the presence and/or absence of a user's ear or head.

Figure 8:
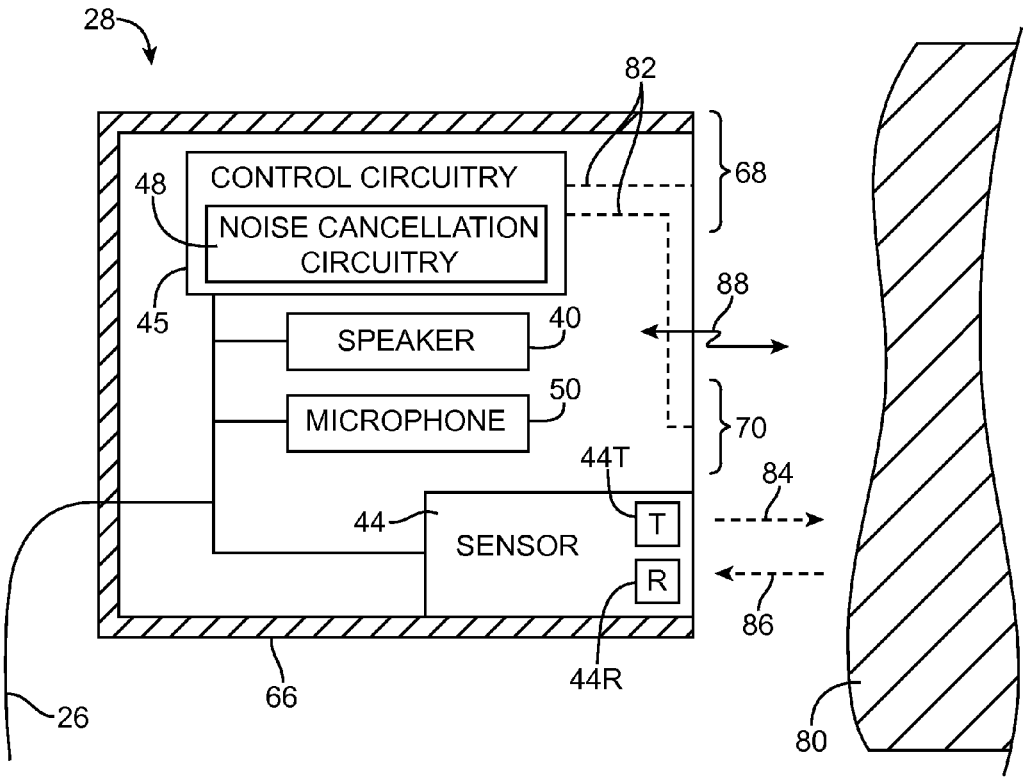
FIG. 8 is a cross-sectional side view of an earphone housing of the type that may be provided with sensor structures for detecting the presence of an ear or other external object in accordance with an embodiment of the present invention.

A cross-sectional side view of an illustrative earbud with a speaker driver and an associated ear presence sensor is shown in FIG. 8. As shown in FIG. 8, earbud 28 may have a housing such as housing 66. Speaker 40 may be mounted within housing 66 overlapping an acoustic grill formed from structures such as mesh 68 and 70 or other acoustic mesh. During operation, sound 88 may pass through the acoustic mesh. For example, speaker 40 may produce sound that is received by a user's ear or other external object 80.

When external object 80 is sufficiently close to earbud 28, the presence of external object 80 may be detected. For example, control circuitry 45 may measure the resistance between mesh electrodes 68 and 70 using conductive paths 82 or may use capacitance measurements in monitoring for the presence of object 80. The measured resistance (or capacitance) may then be used to determine whether earbud 28 is in the user's ear or is out of the user's ear. Control circuitry 45 may also use sensors such as sensor 44 of FIG. 8 to monitor for the presence or absence of external objects such as the user's ear. As shown in FIG. 8, sensor 44 may have a transmitter such as transmitter 44T and may have a receiver such as receiver 44R. During operation of sensor 44, sensor 44 may transmit signals such as signal 84 and may gather reflected signals such as signal 86. The strength of received signal 86 may be used to measure whether or not external object 80 is in the presence of earbud 28.

Sensor 44 may be a light-based sensor. For example, transmitter 44T may be a light-emitting diode or laser that emits light 84 (e.g., infrared light, visible light, etc.) and receiver 44R may be a light detector (e.g., a photodiode or phototransistor) that measures the amount of light 84 that is reflected as reflected light 86 from external object 80. When the amount of light that is reflected from external object 80 is high, circuitry 45 can conclude that earbud 28 is in the user's ear. When the amount of light that is reflected from external object 80 is low, circuitry 45 can conclude that earbud 28 is out of the user's ear.

If desired, sensor 44 may be a sensor that emits and receives acoustic signals. For example, transmitter 44T may be an ultrasonic signal transducer that transmits ultrasonic signals 84. Receiver 44R may be an ultrasonic signal receiver that measures the amount of corresponding ultrasonic signal 84 that is reflected as reflected signal 86 from external object 80. When the amount of ultrasonic signal that is reflected from external object 80 is low, circuitry 45 can conclude that earbud 28 is not in the user's ear. When the amount of ultrasonic signal that is reflected from external object 80 is high, circuitry 45 can conclude that earbud 28 is currently in the user's ear.

In configurations where noise cancellation operations are performed locally in accessory 20, circuitry 45 in accessory 20 may use information from sensor structures 44 to control noise cancellation circuitry 48. For example, when information from sensor structures 44 indicates that earphones 20 have been removed from a user's ears, control circuitry 45 may automatically deactivate noise cancellation circuitry 48. When information from sensor structures 44 indicates that earphones 20 have been placed in or on a user's ears, control circuitry 45 may automatically deactivate noise cancellation circuitry 48, thereby conserving the battery life of earphones 20.

In configurations where noise cancellation operations are performed remotely in device 10, circuitry 32 (FIG. 2) in accessory 20 may receive information from sensor structures 44 via cable 26. Circuitry 32 may control noise cancellation functions based on the information from sensor structures 44. For example, when information from sensor structures 44 indicates that earphones 20 have been removed from a user's ears, control circuitry 32 may automatically deactivate noise cancellation circuitry 46. When information from sensor structures 44 indicates that earphones 20 have been placed in or on a user's ears, control circuitry 32 may automatically activate noise cancellation circuitry 46, thereby conserving the battery life of device 10.

Figure 9:
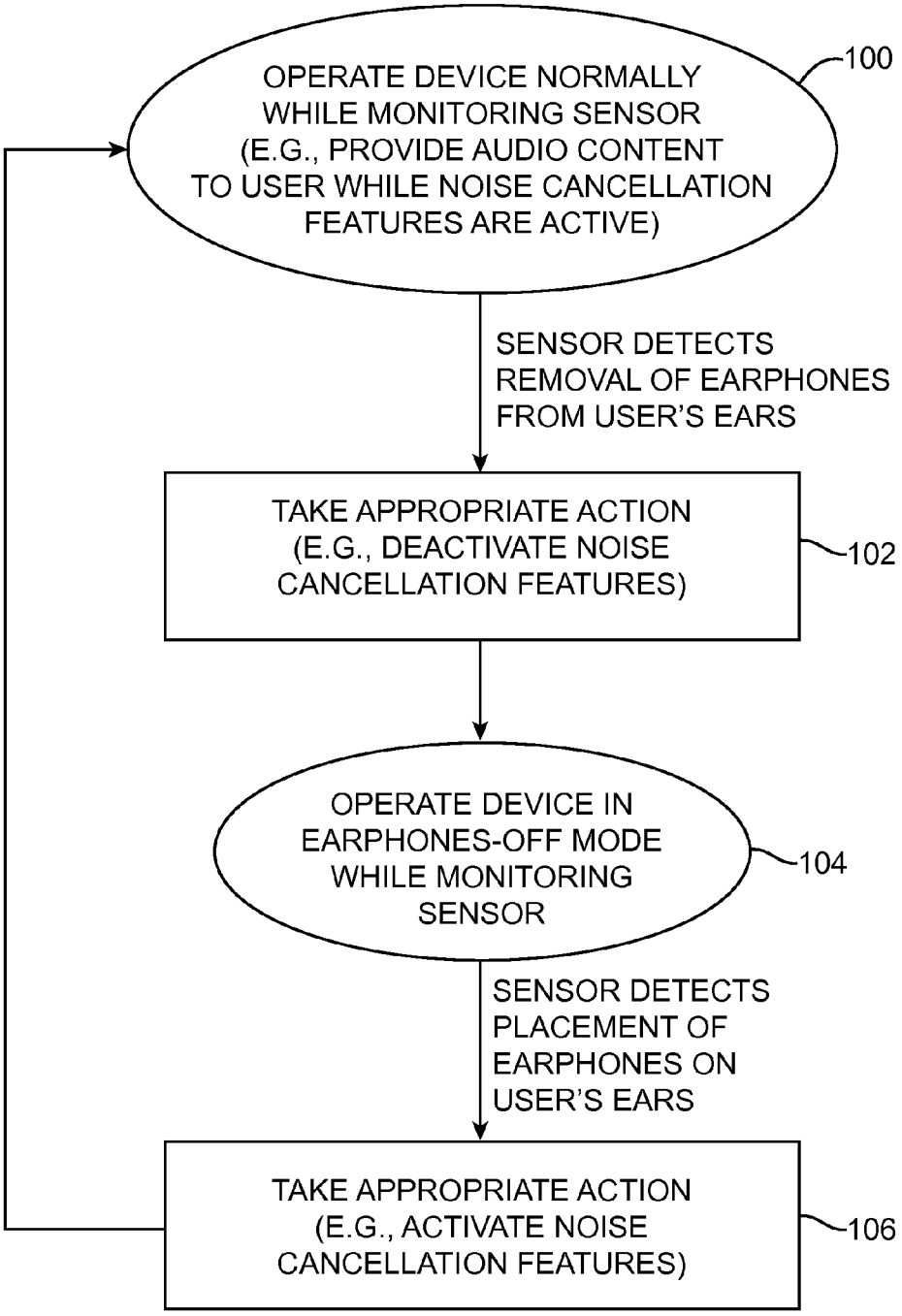
FIG. 9 is a flow chart of illustrative steps involved in using an electronic device and accessory having noise cancellation features in accordance with an embodiment of the present invention.

A flow chart of illustrative steps involved in using system 8 is shown in FIG. 9. During the operations of step 100, earphones 20 may be located in or on the ears of a user and may be operated normally while using sensor circuitry 44 to monitor for the presence or absence of speaker housings 28 of accessory 20 in or on the ears of a user. In configurations where earphones 20 are over-the-ear headphones (FIG. 7), sensor circuitry 44 may be used to monitor the presence or absence of the user's head near headband 78 or the presence or absence of the user's ears near over-the-ear speaker housings 28. Circuitry 45 (and/or circuitry 32, if desired) may be used in evaluating sensor data and taking appropriate action. Configurations in which control circuitry 45 is used in taking action based on sensor data are sometimes described herein as an example.

Examples of operations that may be performed by system 8 during step 92 include audio-based operations such as playing media content (e.g., media content stored on device 10 or media content provided by an online service), providing a user with audio associated with a telephone call, providing audio associated with a video chat session to the user, or otherwise presenting audio content through earphones 20. Audio may be played in stereo so that left and right earbuds receive corresponding left and right channels of audio, may be played using a multi-channel surround sound scheme, or may be played using a monophonic (mono) sound scheme in which both the left and right channels of audio are identical. During the audio-based operations of step 92, noise cancellation circuitry 48 (or noise cancellation circuitry 46 in device 10) may be active to reduce the impact of ambient noise on the audio content played through earphones 20. Configurations where noise cancellation circuitry 48 in earphones 20 is used to perform noise cancellation operations is sometimes described herein as an example. It should be understood, however, that the steps of FIG. 9 may also be performed in configurations where noise cancellation circuitry (e.g., noise cancellation circuitry 46) is located in device 10.

During the monitoring operation of step 100, circuitry 45 can use user detection sensors 44 to determine whether or not earphones 20 are in or on the user's ears.

If, during the operations of step 100, it is determined that earphones 20 have been removed from the user's ears, circuitry 45 may take suitable action at step 102. For example, circuitry 45 may deactivate noise cancellation circuitry 48 in response to information from sensor structures 44 indicating that earphones 20 have been removed from the user's ears. If desired, circuitry 32 in device 10 may adjust the audio content being played based on the information gathered by sensor structures 44. For example, circuitry 32 may pause or stop the audio content being played, may adjust the playback volume (audio signal drive strength), may switch from a stereo playback scheme to a monophonic playback scheme, or may take other suitable actions based on information from sensor structures 44.

After taking suitable actions at step 102, device 10 can be operated in an earphones-off mode (step 104). For example, earphones 20 may operate with noise cancellation circuitry deactivated (i.e., turned off). This may include continuing to play audio content without performing noise cancellation operations, operating with paused or stopped audio playback, etc.

During the operations of step 104, ear presence sensor structures 44 may be used to monitor for the presence of earphones 20 in or on the ears of the user.

If, during the operations of step 104, sensor structures 44 determine that earphones 20 have been placed in or on the user's ears, appropriate action may be taken at step 106. Suitable actions that may be taken by system 8 in response to earphones 20 being placed in or on the user's ears include activating noise cancellation circuitry 48, resuming media playback, and/or restoring a previous volume level of the media playback (as examples). Operations may then proceed to step 100, where system 8 may operate in an earphones-on mode while circuitry 45 monitors sensor structures 44 to determine when earphones 20 are removed from the user's ears.

The foregoing is merely illustrative of the principles of this invention and various modifications can be made by those skilled in the art without departing from the scope and spirit of the invention. The foregoing embodiments may be implemented individually or in any combination.

What is claimed is:

1. Earphones, comprising:

speakers;

noise cancellation circuitry;

ear presence sensor structures, wherein the ear presence sensor structures comprise light-based sensor structures having at least one light source that emits infrared light and at least one light detector that detects the infrared light emitted by the at least one light source;

control circuitry configured to gather information from the ear presence sensor structures indicating whether the speakers are present at the ears of a user and configured to adjust the noise cancellation circuitry in response to the information from the ear presence sensor structures;

housing structures in which the speakers are mounted, wherein at least one light-based sensor structure is mounted in the housing structures; and a headband that connects the housing structures, wherein at least one light-based sensor structure is mounted in the headband, and wherein the control circuitry adjusts the noise cancellation circuitry in response to the information from the light-based sensor structures in the housing structures and the light-based sensor structures in the headband.

2. The earphones defined in claim 1 further comprising a battery, wherein the control circuitry is configured to adjust the noise cancellation circuitry to reduce power consumption of the battery.

3. A method for operating a pair of earphones having noise cancellation circuitry and configured to play audio content for a user comprising:

with control circuitry in the earphones, gathering information from ear presence sensor structures in the earphones on whether the earphones are present at the ears of the user; and in response to the information from the ear presence sensor structures, adjusting the noise cancellation circuitry in the earphones, wherein the ear presence sensor structures comprise an accelerometer-based sensor that detects changes in acceleration, wherein gathering information from the ear presence sensor structures comprises gathering earphone movement information from the accelerometer-based sensor, and wherein adjusting the noise cancellation circuitry comprises deactivating the noise cancellation circuitry in response to the earphone movement information indicating that the earphones are in motion.

4. The method defined in claim 3 wherein the information indicates that the earphones are not present at the ears of the user based on the detected motion of the earphones and wherein adjusting the noise cancellation circuitry comprises deactivating the noise cancellation circuitry in response to determining that the earphones are not present at the ears of the user.

5. The method defined in claim 4 wherein the audio content is played through a pair of speakers, the method further comprising:

adjusting the audio content that is played through the speakers in response to determining that the earphones are not in the ears of the user.

6. The method defined in claim 5 wherein adjusting the audio content that is played through the speakers comprises pausing the audio content that is played through the pair of speakers.

7. The method defined in claim 3 wherein the information indicates that the earphones are present at the ears of the user and wherein adjusting the noise cancellation circuitry comprises activating the noise cancellation circuitry in response to determining that the earphones are present at the ears of the user.

8. An electronic device operable to receive information from ear presence sensor structures in earphones coupled to the electronic device, comprising:

noise cancellation circuitry; and control circuitry configured to gather information from the ear presence sensor structures indicating whether speakers in the earphones are present at the ears of a user and configured to adjust the noise cancellation circuitry in response to the information from the ear presence sensor structures, wherein adjusting the noise cancellation circuitry comprises deactivating the noise cancellation circuitry while continuing to play audio content through the speakers.

9. The electronic device defined in claim 8 wherein the ear presence sensor structures comprise an accelerometer-based sensor and wherein the control circuitry is configured to gather earphone movement information from the accelerometer-based sensor.

10. The electronic device defined in claim 8 further comprising a battery, wherein the control circuitry is configured to adjust the noise cancellation circuitry to reduce power consumption of the battery.

11. The electronic device defined in claim 8 wherein the control circuitry is configured to adjust audio playback to the earphones based on the information from the ear presence sensor structures.

12. The electronic device defined in claim 8 wherein the control circuitry is configured to pause audio playback to the earphones based on information from the ear presence sensor structures indicating that the speakers in the earphones are not present at the ears of the user.

13. A method for operating an electronic device having noise cancellation circuitry and configured to play audio content for a user through a pair of earphones, comprising:

with control circuitry in the electronic device, gathering information from ear presence sensor structures in the earphones on whether the earphones are present at the ears of the user of the electronic device; and in response to the information from the ear presence sensor structures, adjusting the noise cancellation circuitry in the electronic device, wherein the ear presence sensor structures comprise an accelerometer-based sensor that detects changes in acceleration, wherein gathering information from the ear presence sensor structures comprises gathering earphone movement information from the accelerometer-based sensor, and wherein adjusting the noise cancellation circuitry comprises deactivating the noise cancellation circuitry in response to the earphone movement information indicating that the earphones are in motion.

14. The method defined in claim 13 wherein the information indicates that the earphones are not present at the ears of the user based on the detected motion of the earphones and wherein adjusting the noise cancellation circuitry comprises deactivating the noise cancellation circuitry in response to determining that the earphones are not present at the ears of the user.

15. The method defined in claim 14 further comprising:

adjusting the audio content that is played through the earphones in response to determining that the earphones are not present at the ears of the user.

16. The method defined in claim 15 wherein adjusting the audio content that is played through the earphones comprises pausing the audio content that is played through earphones.

17. The method defined in claim 13 wherein the information indicates that the earphones are present at the ears of the user and wherein adjusting the noise cancellation circuitry comprises activating the noise cancellation circuitry in response to determining that the earphones are present at the ears of the user.

* * * * *